United States Patent [19]

Fowler

[11] Patent Number: 4,685,972

[45] Date of Patent: Aug. 11, 1987

[54] PROCESS FOR REMOVING PCB'S FROM ELECTRICAL APPARATUS

[75] Inventor: David E. Fowler, Gainesville, Fla.

[73] Assignee: Quadrex HPS, Inc., Gainesville, Fla.

[21] Appl. No.: 631,909

[22] Filed: Jul. 18, 1984

[51] Int. Cl.[4] ..... B08B 5/00

[52] U.S. Cl. ..... 134/12; 134/22.1; 134/31; 134/109

[58] Field of Search ..... 134/11, 12, 22.1, 31, 134/109; 202/170; 141/1, 59, 92

[56] References Cited

U.S. PATENT DOCUMENTS

| | | | |
|---|---|---|---|
| 3,177,126 | 4/1965 | Charreau | 202/170 |
| 4,341,567 | 7/1982 | Roehl | 134/11 |
| 4,425,949 | 1/1984 | Rowe, Jr. | 134/11 |
| 4,483,717 | 11/1984 | Olmsted et al. | 134/11 |

*Primary Examiner*—George Yeung

*Attorney, Agent, or Firm*—Bernard A. Reiter; Mark G. Bocchetti

[57] ABSTRACT

Disclosed is a process for removing polychlorinated biphenyls from electrical apparatus, particularly transformers, to achieve concentration levels of 50 ppm or less as required by the EPA. A dielectric fluid having a relatively low boiling point as compared to polychlorinated biphenyls and other contaminants and in which PCB's are soluble is selected. There is an external cooling loop through which the dielectric fluid is circulated maintaining the temperature and pressure of the transformer within its design limits. There is an external distillation loop where the liquid removed from the transformer is heated to boiling point of the selected dielectric fluid thereby vaporizing the dielectric fluid and leaving the polychlorinated biphenyls in liquid phase in the distillation vessel. The dielectric fluid vapor is then condensed and returned to solubilize remaining PCB's in the transformer.

21 Claims, 2 Drawing Figures

PROCESS FOR REMOVING PCB'S FROM ELECTRICAL APPARATUS

BACKGROUND OF THE INVENTION

1. Field of the Invention

The invention relates in general to electrical inductive apparatus, such as transformers, and more particularly to the removal of residual polychlorinated biphenyl from the internal components in electrical inductive apparatus.

2. Description of the Prior Art

Since the early 1930's, electrical transformers used in locations sensitive to fires or fire-damage such as subways, buildings and factories have been constructed with a polychlorinated biphenyl insulating and cooling liquid, which liquids are commonly called PCB's. The PCB's were chosen for these applications because of their high dielectric strength and their fire resistant characteristics.

In 1976, the manufacture of PCB was outlawed in the United States (15 U.S.C.A. §2605 (3) (A)(i)) because of evidence of their carcinogenic nature. The Federal Toxic Substances Control Act has made it mandatory that the use of PCB's in industry be phased out over a short period of time. The Environmental Protection Agency has determined that PCB concentrations of 50 ppm or less in the dielectric fluid of a transformer are considered safe for transformer operation. The EPA has further designated that a PCB transformer may be re-classified as "Non-PCB" if after decontamination is completed (and disengaged) for 90 days, the residual PCB concentration in the dielectric fluid is below 50 ppm.

Because initial PCB concentrations in these transformers was as high as 600,000–1,000,000 ppm and the PCB's impregnate the solid cellulosic insulation (wood and paper) and other adsorbent insulating materials used in transformers, merely flushing the transformer with another dielectric fluid or a solvent may have the affect of immediately reducing the PCB concentration to an acceptable level, but after a period of operation, the concentration will rise above the limit set by the EPA due to the concentrated PCB's continuously leaching out of the solid insulation.

The prior art purports to teach a method of removing PCB's from transformers through the use of an activated carbon filter located in a thermal siphon attached to the transformer while it is energized (U.S. Pat. No. 4,124,834). The activated carbon filters have a finite ability to absorb PCB's. It is therefore necessary to continually change out the activated carbon filters and monitor the concentrations of PCB's. The process is continued until the concentration of PCB in the dielectric fluid is below 50 ppm. Although able to reach 50 ppm in approximately 30–60 days, when disengaged from the transformer, the concentration of PCB's in the fluid, which is a poor solvent at best for PCB, rapidly leaches back to concentration well above 50 ppm. To date, it is believed this process has been operated continuously on transformers for two (2) to three (3) years without successfully keeping the PCB concentration below 50 ppm after disengagement.

There is also in the prior art a process which appears to suggest circulation of a chlorinated or halogonated aliphatic hydrocarbon vapor through the transformer (U.S. Pat. No. 4,425,949). Equipment required for this method include two pumps, one decanter, one thermosiphoned reboiler, two inert chillers, one condenser, one superheat exchanger, one reservoir and an optional distillation vessel. The requirement of this quantity and complexity of equipment is apparently dictated by the fact that the transformer cleansing is performed in vapor rather than liquid phase. This magnitude of complexity would obviously create high initial costs, high operating costs and high maintenance costs. Also, the process described in U.S. Pat. No. 4,425,949 must be practiced while the transformer is out of service because existing PCB transformer are not designed to operate in a dielectric gas atmosphere and the resulting lack of heat dissipation would cause the transformer to fault or melt down. The inability to operate the transformer while decontamination is taking place precludes the heating of and subsequent expansion of the transformer windings and core. The non-energized condition excludes the vapor cleansing process of U.S. Pat. No. 4,425,949 from access to internally trapped PCB which will remain there until the transformer is refilled and re-energized.

SUMMARY OF THE INVENTION

A feature and advantage of the present invention resides in the provision for an apparatus and process for removing PCB's from transformers and for maintaining a satisfactorily low level of PCB's therein.

Another feature and advantage of the present invention resides in the provision for both a cost and time efficient apparatus and process that will effectively remove PCB's from a transformer so that the leaching of residual PCB into the dielectric fluid will not exceed 50 ppm.

Another feature and advantage of the present invention is the provision for an apparatus and process removing PCB's from transformers that does not require constant monitoring.

Yet another feature of the present invention is the provision for an economical apparatus and process for removing PCB's from transformers which is not equipment intensive.

Yet another feature and advantage of the present invention resides in the provision for an apparatus and process which can be used while a transformer is in service without substantially affecting the transformers efficiency or power rating.

Another feature and advantage of the present invention resides in the provision for an apparatus and process which can be used while a transformer is not in service.

A still further feature of the present invention is the availability of apparatus and process for PCB removal which is easily retrofitted on an existing PCB's filled or contaminated transformer.

An additional advantage of the present invention is that the transformer may be placed back into service quickly and the decontamination process allowed to continue without additional interruption of electrical service.

A further feature of the present invention is the provision for an apparatus and process which is of sufficient compactness and lightweight enough to permit access to the PCB transformer vaults which are often characterized as being in remote, hard to reach areas.

These and numerous other numerous features and advantages of the present invention will become apparent upon careful reading of the detailed description, claims and drawings herein, wherein is described an apparatus and process for removing, collecting and isolating PCB's. This is accomplished by the use of trichlorotrifluoroethane as both a dielectric fluid and a solvent and the connection of two fluid circuit means to a transformer. Other fluids having similar characteristics of dielectric strength and nonflammability as well as a boiling point much lower than the boiling point of PCB's and in which PCB's are soluble could be used in the process. Perchloroethylene is such a material.

Other suitable dielectric fluid/solvents may include perfluorocyclic ether ($C_6Fl_2O$), perfluorobicyclo-(2.2.1) heptane, perfluorotriethyl amine, monochloropentadecafluorheptane, perfluorodibutyl ether, and perfluoro-nheptane, although testing has not been performed on the dielectrics to determine:

(1) If PCB's are soluble in them;

(2) If they are nondestructively compatable with transformer internals; and (3) If they form an azeotrope with PCB's. If PCB's are not soluble in one of the above listed dielectrics, or if a particular dielectric will damage the transformer, or if a particular dielectric azeotropes with PCB's, then that dielectric is unsuitable.

The second of these fluid circuit means contains a condenser or other means of cooling through which the dielectric fluid vapor generated by the heat of the transformer will be circulated and the resulting condensate returned to the transformer thereby removing latent heat and controlling the internal atmosphere pressure of the transformer while approximately maintaining the temperature of the dielectric fluid at its boiling point in the transformer. The first fluid circuit means contains a distillation means in which the temperature of the dielectric fluid is raised to the boiling point of the solvent trichlorotrifluoroethane. Advantage is taken of the excess heat generated by the transformer to offset the energy required to distill the solvent. The resulting vapor in the first fluid circuit means is taken overhead from the distillation means to a condenser via a conduit. The condensate is gravitationally transmitted via a conduit to a tank and pumped back to the transformer from the tank. Because the temperature within the distillation means is maintained at the boiling point of trichlorotrifluoroethane, the PCB's, which have a much higher boiling point, remain in liquid phase and are collected at the bottom of the distillation means.

Periodically the PCB's are drained from the bottom of the distillation means to a PCB's waste tank.

Operating the process of the present invention while the transformer is in service is the most effective method of practicing the invention. The porous internals of a transformer expand due to the rise in temperature that occurs when the transformer is in operation. This expansion exposes greater surface area of the porous internals to the dielectric fluid and allows the PCB's saturated in the porous internals to leach out.

Because the leaching or diffusion rate of PCB from the transformer core is largely affected by temperature and concentration gradient (difference in concentration between the PCB in the core and the PCB in the dielectric), it is important to reduce the concentration of PCB in the dielectric to a very low value (less than 2 ppm) as rapidly as possible. The invention causes thus to happen within the first one (1) to five (5) days, depending on transformer volume, and then continuously removes (via distillation) any residual PCB that leaches into the low PCB concentrated dielectric. An additional advantage of operating the transformer while decontaminating it is that the fluctuation of electric current through the transformer causes a swelling and contraction (pumping) action that accelerates the release of PCB from its internal windings and insulation material.

Since the first fluid circuit means draws from the bottom the transformer, other soluble contaminants as well as contaminants of a heavy or particulate nature should also be removed from the transformer by the distillation process of the first fluid circuit means. Other undesirable contaminants may include dust, water, sludge, trichlorobenzene and tetrachlorobenzene.

DESCRIPTION OF THE PREFERRED EMBODIMENT

Figure 1:
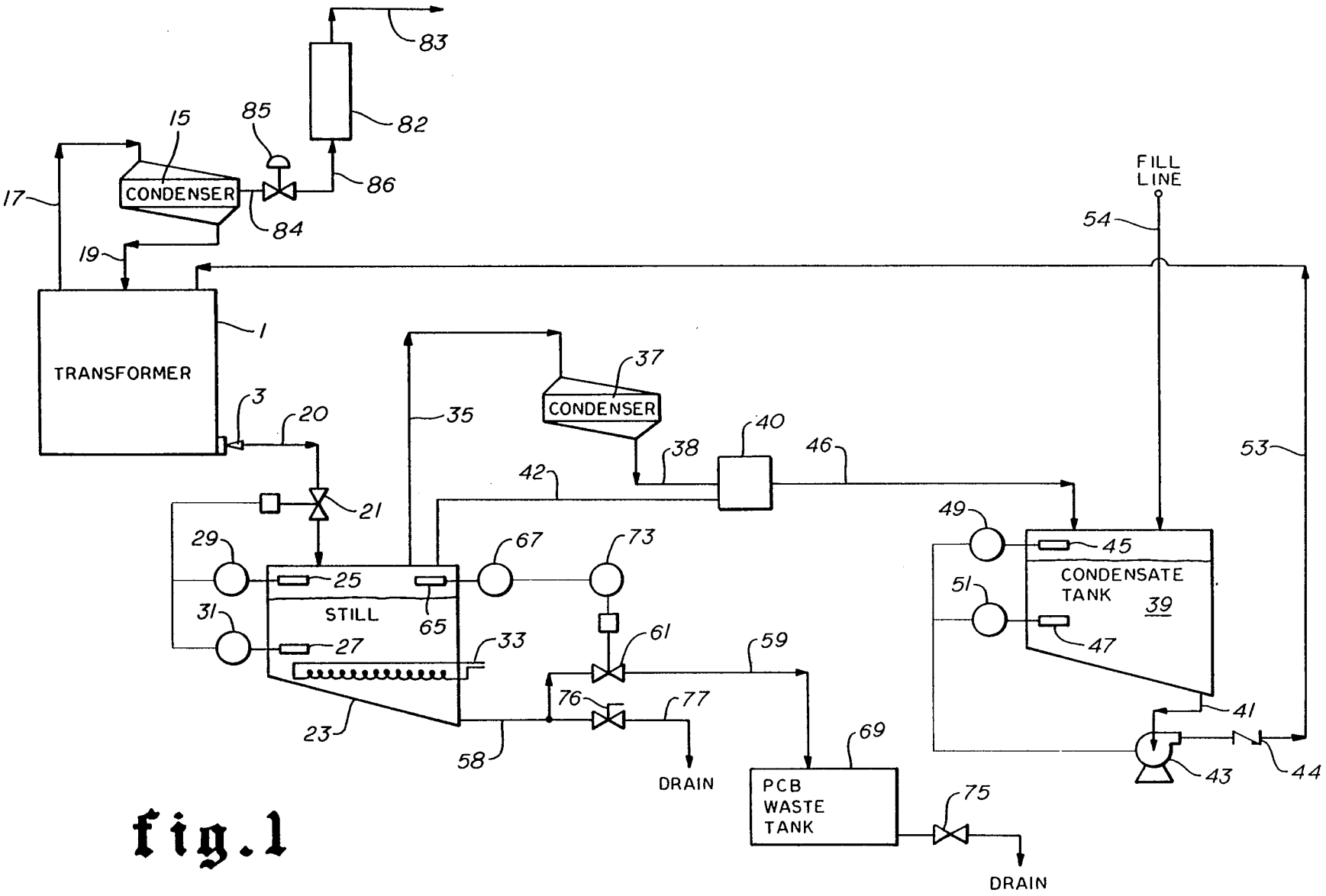
FIG. 1 is a flow diagram of the invention as it is operated in conjunction with an existing PCB transformer.

Referring now to the drawing, FIG. 1 shows an existing transformer to which has been added two fluid circuit means that when operated serve to cool and cleanse the transformer.

For a brief period when the transformer is taken out of service. During this non-operative period, the PCB's are drained from the transformer and the transformer is flushed with a solvent to remove gross residues of PCB and dielectric. That solvent should but is not restricted to being the dielectric fluid which is later used to decontaminate the transformer. The transformer is then refilled (using trichlorotrifluoroethane and for perchloroethylene as the dielectric fluid) and a partial vaccuum pulled on the transformer to evacuate any air and/or moisture that may have been introduced during the flushing and filling stages.

A quick connect fitting 3 is coupled with the existing drain port on the transformer. The dielectric fluid flows through this quick connect fitting 3 and into a conduit 20. The quick connect fitting 3 is the beginning point for a first fluid circuit means. This first fluid circuit means begins by taking dielectric fluid from the transformer and ends by returning dielectric fluid to the transformer.

The first fluid circuit means operates to cleanse the transformer of PCB's. Cleansing is performed by circulating dielectric fluid in liquid phase through the transformer. The PCB's contained in the transformer are soluble in the dielectric fluid and therefore, when the dielectric fluid leaves the transformer in the first fluid circuit means, the dielectric fluid is in solution with PCB's. The solution is then distilled. In the distilling operation, the dielectric fluid is vaporized while the PCB's remain in liquid phase. This is because the dielectric fluid has a boiling point significantly lower than the boiling point of PCB's. The boiling point of the dielectric fluid should be less than the boiling point of PCB's. The dielectric fluid vapor is then condensed and returned to the transformer where it is able to solubilize more PCB.

During the first several hours of operation of the process, the concentration of PCB's in the dielectric fluid rises dramatically (20,000–60,000) ppm). This is because the initial flush of the transformer with trichlorotrifluoroethane does not reach the largely unexposed areas of the porous transformer internals. Therefore, as the transformer heats up during operation, residual PCB's saturated or trapped in the porous internals begin to leach out and go into solution with the dielectric fluid, trichlorotrifluoroethane.

In the first fluid circuit means, from the quick connect fitting 3, the dielectric fluid is transmitted via a conduit 20 through a solenoid valve 21 which controls flow of the dielectric fluid into the distillation means 23. Within the distillation means 23 there is a high level sensor 25 and a low level sensor 27. High level sensor 25 signals a high level controller 29 and a low level sensor 27 signals a low level controller 31. The high level controller 29 and the low level controller 31 actuate the solenoid valve 21 so as to maintain a proper liquid level within the distillation means 23. Necessary heat energy required to reach the boiling point of the dielectric fluid within the distillation means 23 is supplied by an electric resistance coil heater 33. A heat recovery, heat exchanger which draws its energy from the exhaust heat from the condenser 37 may be substituted for the electrical resistance heater. A proper level is any level which allows for a vapor space at the top of the distillation means 23 while maintaining a liquid level in which electric resistance coil heater 33 is completely submerged. As the dielectric fluid boils, the resulting vapor is transmitted through a conduit 35 into a condenser 37. Condensed dielectric fluid from the condenser 37 is conducted via conduit 38 to water separator 40 to separate any water which may have been removed from the transformer from the dielectric fluid. Water thus separated from the dielectric fluid is transmitted to the distillation means 23 through conduit 42. The remaining dielectric fluid is collected via conduit 46 in a condensate tank 39. Located near the bottom of the condensate tank 39 is a suction conduit 41 which feeds a pump 43. There is a high level sensor 45 and a low level sensor 47 located within the condensate tank 39. The high level sensor 45 signals a high level controller 49 and the low level sensor 47 signals a low level controller 51. The high level controller 49 and the low level controller 51 actuate the pump 43 maintaining a proper level within the condensate tank 39. A proper level is any level where the pump 43 is not pumped dry and the tank 39 is not overflowed. The pump 43 discharges through a pressure check valve 44 and a return conduit 53 back to the transformer tying into the existing fill port on the transformer. The pressure check valve 44 in connection with solenoid valve 21, allows the distillation portion of the system to operate at atmospheric pressure or at a different and lower pressure than that at which the transformer operates. This permits the distillation of the dielectric at a lower boiling point (due to lower pressure) and insure less energy requirement for boiling as well as good separation of the dielectric from the contaminant. There is a fill line 54 which empties into condensate tank 39 through which make-up trichlorotrifluoroethane can be added to replace the volume of PCB's and any trichlorotrifluorethane removed. Condensate tank 39 yields some distinct advantages to the process. Although it can be seen that condensate tank 39 can be omitted by merely placing condenser 37 at an elevation above the transformer and draining condenser 37 directly to the transformer, revelation of these advantages will make it clear why condensate tank 39 is part of the preferred embodiment. First, condensate tank 39 allows for a surplus of dielectric fluid/solvent to be placed in the system initially so that there should be no need to add make-up dielectric fluid/solvent to replace that which exists the system when the still bottoms are drained to the PCB waste tank 69. Also, it allows larger quantities of pure dielectric fluid/solvent to be placed within the transformer during the continuous operation of the process while simultaneously allowing larger quantities of PCB contaminated dielectric fluid/solvent to be drained to the distillation means 23. This speeds up the entire process by greatly increasing the rate at which PCB's within the transformed are diluted by the dielectric fluid/solvent. Further, omitting condensate tank 39 and pump 43 would necessitate the omission of check valve 44 and the benefits achieved as previously stated by using a check valve 44 would also be lost.

At the base of distillation means 23 there is a conduit 58 through which still bottoms are transmitted to manually operated gate valve 76 which is normally closed, or to solenoid valve 61. Solenoid valve 61 is operated by controller 67 and which receives a signal from temperature sensor 65 located in the vapor space of distillation means 23. As the concentration of PCB's and other higher boiling contaminants in distillation means 23 rises, the boiling point of the solution of trichlorotrifluoroethane and PCB's also rises which in turn causes a rise in the temperature of the vapor space in distillation means 23.

When temperature sensor 65 senses a temperature of approximately 165° F., controller 67 will open solenoid valve 61 and still bottoms will flow into PCB waste tank 69 via conduit 59. The temperature at which controller 67 is set to actuate solenoid valve 61 can be varied over a large range although it should be remembered that separation by distillation is enhanced as the boiling point of the solution approaches the boiling point of the dielectric fluid. Certainly, a temperature setting other than 165° F. would be selected if a dielectric fluid other than trichlorotrifluoroethane was used in the process. As this occurs, a low liquid level will be sensed by low level sensor 27 and lower level controller 31 will cause solenoid valve 21 to open allowing additional dielectric fluid to flow into the distillation means 23 and flush the still bottoms which are highly concentrated in PCB's into the PCB waste tank 69. After the passing of a preset period of time on timer 73 sufficient to drain and flush the still bottoms, solenoid valve 61 will close and distillation means 23 will resume normal operation. After flushing the PCB's already removed from the transformer to the PCB waste tank 69, the dielectric fluid contained in the distillation means 23 will contain much fewer PCB contaminants. This will mean that the boiling point of the solution will again approach the boiling point of pure trichlorotrifluoroethane and therefore, separation by distillation will be at its optimum. Although it is possible for PCB waste tank 69 to be of a permanent or disposable nature, it is preferable that it be disposable. By making PCB waste tank 69 disposable, it may be removed and replaced by another tank at anytime during the process, thereby also removing the contaminant PCB's from the site. This capability reduces the hazard that may occur if a fire or spill situation were to arise since the majority of the PCB's would already have been removed from the site.

Manually operated gate valve 76 allows the distillation means 23 to be drained at any time during operation or at the completion of operation via conduit 77.

There is a manually operated gate valve 75 through which PCB waste tank 69 may be drained.

There is a second fluid circuit means which operates to cool the dielectric fluid as the dielectric fluid is circulated through it thereby dissipating heat generated by the transformer. The second fluid circuit means also serves to maintain the pressure inside the transformer within the transformer's operating limits. Note that existing PCB transformers were built for low pressure operation (5–7 PSIA) and must have adequate vapor pressure control in order to safely operate. Temperature and pressure control are accomplished through the use of a condenser 15. A portion of the dielectric fluid is vaporized by the heat generated by the operation of the transformer. This dielectric fluid vapor is transmitted to the condenser 15 via conduit 17 by convection. A forced draft system for transmitting vapor through the second fluid circuit means could also be employed where more rapid cooling is required or where elevations prevent the natural rise required for convective cooling.

The dielectric fluid condensed to liquid phase by condenser 15 is transmitted gravitationally back to the transformer via conduit 19. Removing the latent heat of the dielectric fluid in this manner is an extremely efficient way to cool the transformer. While simultaneously limiting the vapor pressure within the transformer.

There is an emergency pressure vent 85 which is connected to condenser 15 by conduit 84. Should a power failure occur, the second fluid circuit means will not serve to cool the dielectric fluid and the residual heat remaining in the transformer will not be dissipated. This may cause a pressure build-up in condenser 15. In such a situation, emergency pressure vent 85 will open thereby relieving pressure within the condenser. Vapor escaping the condenser 15 is transmitted through conduit 84, emergency pressure vent 85, conduit 86, carbon vapor absorption column 82, and conduit 83. Vapor absorption column 82 absorbs the dielectric fluid/solvent vapor thereby preventing the flooding of any enclosed area where the transformer may be located with dielectric vapor which can be asphixiating. Further, although it is extremely unlikely that the temperature reached in such situation will be sufficient to cause any vaporization of PCB's, the vapor absorption column 82 will also adsorb any PCB's attempting to migrate with the dielectric vapor through emergency pressure vent 85.

Figure 2:
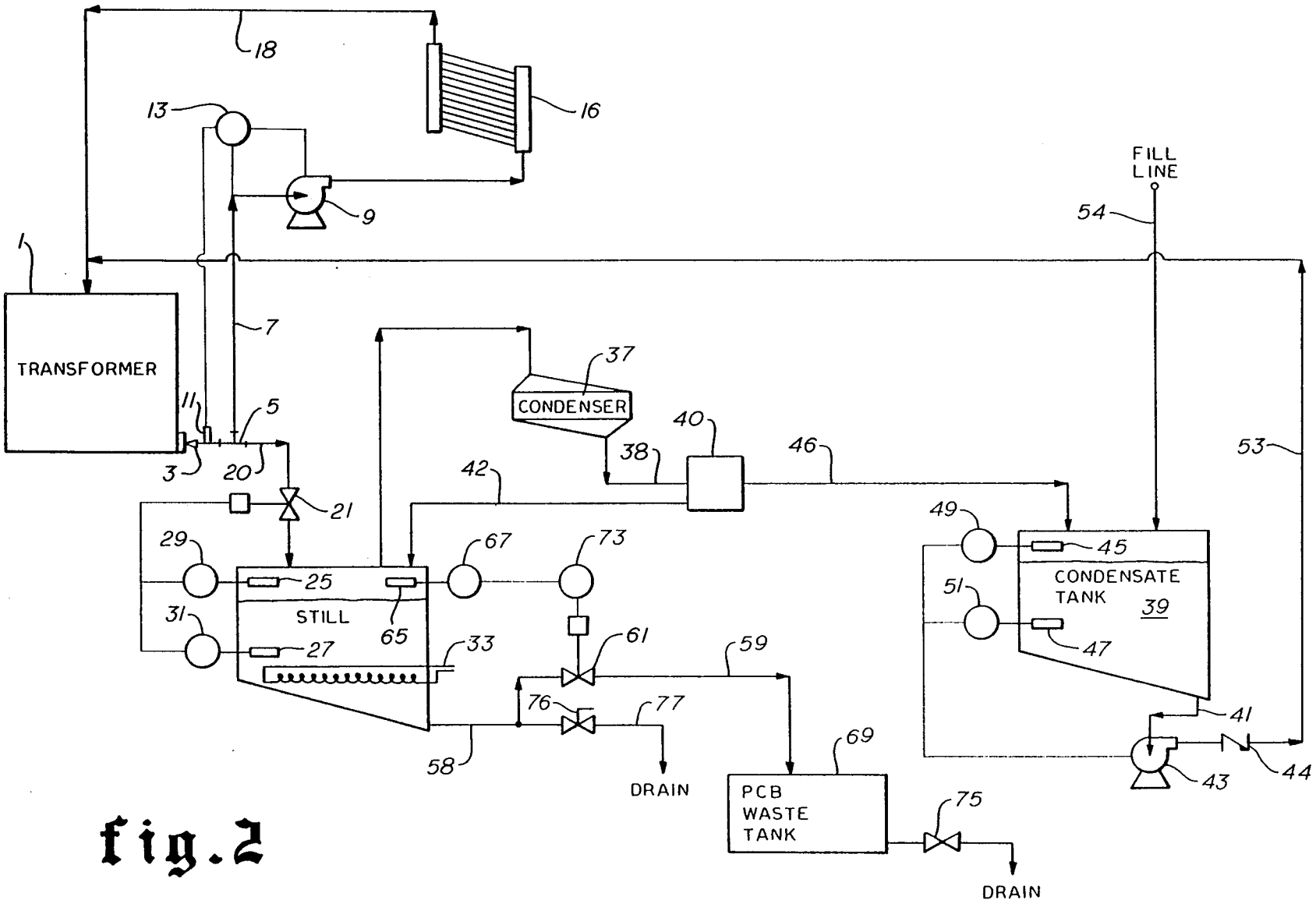
FIG. 2 is a flow diagram of the invention as it is operated in conjunction with an existing PCB transformer showing an alternate embodiment cooling means.

An alternative method of cooling the transformer is shown in FIG. 2. Here, the second fluid circuit means may accomplish cooling of the dielectric fluid through the use of an air or mechanically cooled heat exchanger 16. Dielectric fluid is transmitted to pump 9 via quick connect fitting 3, conduit tee 5 and conduit 7. There is a temperature sensor 11 located in the conduit 20. The temperature sensor 11 signals a temperature controller 13 which serves to actuate the pump 9. The pump 9 discharges the dielectric fluid through a cooled heat exchanger 16. The dielectric fluid is then circulated through conduit 18 and back to the transformer. The dielectric fluid is circulated through this second fluid circuit means by the pump 9 which is controlled by the temperature controller 13 to maintain the temperature of the dielectric fluid in the transformer near but below its boiling point.

This alternate method of cooling is particularly useful when there is a potential nucleate boiling situation at the surface of the transformer windings. Nucleate boiling is boiling in which bubble formation is at the liquid-solid interface. It is possible that such a bubble would stretch from one winding to another thereby displacing the dielectric fluid. If this were to occur, it is likely that for high voltage operation there would be damaging arcing between the windings. This alternate method of cooling can be used to prevent nucleate boiling by maintaining the temperature of the dielectric fluid below its boiling point.

In an another alternative embodiment, it can be seen that condenser 15 and condenser 37 shown in FIG. 1 could be replaced by a single condenser serving a dual role of maintaining the temperature and pressure within the transformer and condensing distilled dielectric fluid vapor for return to the transformer.

Further, placing such a dual purpose condenser at an elevation above the transformer would eliminate the need to do any pumping. Vapor would rise by convection from both the transformer and the distillation means 23 to the dual purpose condenser and the resulting dielectric fluid in liquid phase would flow gravitationally from the dual purpose condenser to the transformer.

It should also be noted that if perchloroethylene is used as the dielectric fluid/solvent in an operating transformer, it may not be necessary to use an external cooling loop. This is because the boiling point of perchloroethylene is significantly higher than the boiling point of trichlorotrifluoroethane and, depending on the transformer, the heat generated by the operation of the transformer may not be sufficient to boil perchloroethylene. The disadvantage of using perchloroethylene is that PCB's are more difficult to separate from the perchloroethylene because the perchloroethylene has a substantially higher boiling point and latent heat of vaporization than trichlorotrifluoroethane.

In summary, there has been disclosed a method of removing PCB's from transformers relying on distillation, which, except for a brief, initial shut-down period, can, but need not be performed while the transformer is in operation. This is important due to the fact that many existing PCB transformers are in locations that make it impractical if not impossible for replacement or, at least, make it impractical for the transformer to be out of service for an extended period.

Additionally the process is extremely energy efficient in that it uses the heat generated by an operating transformer to accelerate the extraction of PCB's. Further, because the dielectric fluid is maintained at temperature approximately equal to its boiling, the amount of additional heat required for distillation is minimized.

Should it be desired to practice the invention while the transformer is not in service, it may not be necessary to install or use the second fluid circuit means because the transformer itself would not be adding heat to the dielectric fluid/solvent and vaporization of the dielectric fluid/solvent within the transformer would not occur. In other words, cooling of the dielectric fluid/solvent in the transformer would not be required because, in this situation, the dielectric fluid/solvent would not be serving to dissipate the heat generated by an active transformer.

However, practicing the invention in such manner will not be as efficient as practicing the invention while the transformer is active. When the transformer is operating the resulting heat causes expansion of the transformer internals, especially the internal windings wrapped with cellulosic material thereby allowing more rapid and complete penetration of the dielectic fluid/solvent.

Note that the invention may be practiced on a transformer in non-operating mode at an accelerated rate if an external heat source is used to heat the dielectric fluid/solvent or the transformer core. In either case, i.e., actual or simulation operation the added heat would cause an expansion of transformer internals similar to that described for an operating transformer. However, in such case, care would have to be taken not to overpressure the transformer due to the added heat causing significant vaporization of the dielectric fluid/solvent. If the temperature of the dielectric fluid/solvent reaches its boiling point, it would be necessary to utilize an external cooling means.

It is contemplated that once the transformer is cleansed of PCB's, the dielectric fluid/solvent is drained from the transformer and replaced with another suitable dielectric fluid such as silicon oil. However, it would also be possible to remove the cleansing circuit from the transformer while leaving the cooling circuit in place. This would allow the transformer to be operated on a permanent basis using trichlorotrifluoroethane as the dielectric fluid.

What is claimed is:

1. A process for removing polychlorinated biphenyls from an electrical apparatus comprising:

(a) filling the electrical apparatus with a dielectric fluid in liquid state in which polychlorinated biphenyls are soluble, thereby providing adequate insulation during the operation of the electrical apparatus;

(b) dissolving polychlorinated biphenyls contained within the electrical apparatus into said dielectric fluid to form a solution;

(c) conducting said solution from the electrical apparatus to a cleansing means;

(d) cleansing said solution to thereby separate polychlorinated biphenyls from said dielectric fluid so that said dielectric fluid is re-usable; and (e) recirculating said dielectric fluid back to the electrical apparatus for reuse, said steps effectively and substantially removing the polychlorinated biphenyls from the electrical apparatus so that the leaching of residual polychlorinated biphenyls into the dielectric fluid will not exceed 50 ppm.

2. A process for removing polychlorinated biphenyls and other contaminants from an electrical apparatus comprising:

(a) substantially filling the electrical apparatus with a dielectric fluid in liquid state thereby providing adequate insulation in which polychlorinated biphenyls are soluble, during operation of the electrical apparatus;

(b) dissolving polychlorinated biphenyls contained within the electrical apparatus into said dielectric fluid to form a solution;

(c) conducting said solution from the electrical apparatus to a cleansing means;

(d) cleansing said solution to thereby separate polychlorinated biphenyls from said dielectric fluid so that said dielectric fluid is reusable;

(e) recirculating said dielectric fluid back to the electrical apparatus; and (f) cooling the electrical apparatus so that the temperature and pressure of the electrical apparatus is maintained within satisfactory limits, said steps effectively and substantially removing the polychlorinated biphenyls from the electrical apparatus so that the leaching of residual polychlorinated biphenyls into the dielectric fluid will not exceed 50 ppm.

3. A process as recited in claim 2 wherein said cooling is accomplished by:

(a) conducting the vapor of said dielectric fluid generated by the heat of the electrical apparatus to a condensing means;

(b) condensing said dielectric fluid vapor to liquid phase so that the latent heat of said dielectric fluid is removed;

(c) recirculating said dielectric fluid condensed by said condensing means back to the electrical apparatus so that the electrical apparatus is maintained at a temperature approximately equal to the boiling point of said dielectric fluid.

4. A process as recited in claim 2 wherein:

said cooling is accomplished by circulating said dielectric fluid from the electrical apparatus through a mechanical heat exchanger means and back to the electrical apparatus so that the temperature within the electrical apparatus is maintained at the desired level.

5. A process as recited in claim 1 or 3, wherein said dielectric fluid is comprised of trichlorotrifluoroethane.

6. A process as recited in claim 1 wherein:

said dielectric fluid is comprised of perchloroethylene.

7. A process as recited in claim 1 or 2 further comprising:

draining the polychlorinated biphenyls cleansed from said solution into a waste receptacle.

8. A process as recited in claim 1 or 2 wherein:

said dielectric fluid has a boiling point lower than the boiling point of polychlorinated biphenyls so that said dielectric fluid is separated from the polychlorinated biphenyls by distillation.

9. A process as recited in claim 1 or 2 wherein:

said cleansing is accomplished by distilling said solution and thus causing vaporization of said dielectric fluid while PCB's remain in liquid phase; and condensing the dielectric fluid vapor generated by said distilling step in preparation for the recirculating step.

10. A process for removing polychlorinated biphenyls and other contaminants from electrical apparatus, comprising the steps of:

(a) substantially filling the electrical apparatus with a liquid dielectric fluid having a boiling point lower than that of polychlorinated biphenyls and in which the polychlorinated biphenyls are soluble so as to be dissolved within said liquid dielectric fluid, said liquid dielectric fluid providing adequate insulation during the operation of the electrical apparatus;

(b) removing the liquid dielectric fluid from the electrical apparatus and cleansing the polychlorinated biphenyls from said fluid; and (c) recirculating the cleansed liquid dielectric fluid back to the electrical apparatus for reuse therein, said steps effectively and substantially removing the polychlorinated biphenyls from the electrical apparatus so that the leaching of residual polychlorinated biphenyls into the dielectric fluid will not exceed 50 ppm.

11. A process for removing polychlorinated biphenyls and other contaminants from electrical apparatus, and wherein the steps for so removing polychlorinated biphenyls from operating electrical apparatus are:

(a) introducing to the apparatus a liquid solvent having a boiling point lower than that of polychlorinated biphenyls and in which the polychlorinated biphenyls are soluble so as to be dissolved within said solvent, said solvent having sufficient dielectric properties to insulate the electrical apparatus during the operation of the electrical apparatus;

(b) removing said liquid solvent from the electrical apparatus and cleansing the polychlorinated biphenyls from said solvent; and (c) recirculating said cleansed liquid solvent back to the electrical apparatus for reuse therein, said steps effectively and substantially removing the polychlorinated biphenyls from the electrical apparatus so that the leaching of residual polychlorinated biphenyls into the dielectric fluid will not exceed 50 ppm.

12. A process for removing polychlorinated biphenyls from an electrical apparatus comprising:

(a) introducing a dielectric fluid in liquid state in which polychlorinated biphenyls are soluble, to the electrical apparatus thereby filling the electrical apparatus with said dielectric fluid so that the polychlorinated biphenyls contained within the electrical apparatus form a solution with said dielectric fluid;

(b) elevating the temperature of the dielectric fluid above ambient but below the boiling point of said dielectric fluid;

(c) conducting said solution from the electrical apparatus to a cleansing means for separating said dielectric fluid from the polychlorinated biphenyls;

(d) cleansing said solution to thereby separate polychlorinated biphenyls from said dielectric fluid so that said dielectric fluid is substantially free of polychlorinated biphenyls;

(e) recirculating said dielectric fluid back to the electrical apparatus for substantially continuous removal of polychlorinated biphenyls from the electrical apparatus, said steps effectively and substantially removing the polychlorinated biphenyls from the electrical apparatus so that the leaching of residual polychlorinated biphenyls into the dielectric fluid will not exceed 50 ppm

13. A process for removing polychlorinated biphenyls and other contaminants from an non-operating electrical apparatus comprising:

(a) introducing a dielectric fluid in liquid phase in which polychlorinated biphenyls are soluble to the electrical apparatus thereby filling the electrical apparatus with said dielectric fluid so that the polychlorinated biphenyls contained within the electrical apparatus form a solution with said dielectric fluid;

(b) energizing the electrical apparatus thereby placing the electrical apparatus back in operation;

(c) conducting said solution from the electrical apparatus to a cleansing means so that said dielectric fluid is separated from the polychlorinated biphenyls;

(d) cleansing said solution to thereby separate polychlorinated biphenyls from said dielectric fluid so that said dielectric fluid is rendered substantially free of polychlorinated biphenyls;

(e) recirculating said dielectric fluid back to the electrical apparatus; and (f) cooling the operating electrical apparatus so that the temperature and pressure of the operating electrical apparatus is maintained within its operating limits, said steps effectively and substantially removing the polychlorinated biphenyls from the electrical apparatus so that the leaching of residual polychlorinated biphenyls into the dielectric fluid will not exceed 50 ppm.

14. A process as recited in claim 13 wherein said cooling is accomplished by:

(a) conducting the vapor of said dielectric fluid generated by the heat of the operating electrical apparatus from the electrical apparatus to a condensing means;

(b) condensing said dielectric fluid vapor generated by the heat of the operating electrical apparatus to liquid phase so that the latent heat of said dielectric fluid is removed;

(c) recirculating said dielectric fluid condensed by said condensing means back to the electrical apparatus so that the electrical apparatus is maintained at a temperature approximately equal to the boiling point of said dielectric fluid.

15. A process for removing polychlorinated biphenyls and other contaminants from transformers and other electrical apparatus, and wherein the steps for so removing polychlorinated biphenyls from nonoperating electrical apparatus are:

(a) continuously introducing to the electrical apparatus a liquid solvent having a boiling point lower than that of polychlorinated biphenyls and in which the polychlorinated biphenyls are soluble so as to be dissolved within said solvent;

(b) continuously removing said liquid solvent from the electrical apparatus and cleansing the polychlorinated biphenyls from said liquid solvent;

(c) continuously recirculating the cleansed liquid solvent back to the electrical apparatus for reuse therein; and (d) maintaining the level of said liquid solvent in the electrical apparatus such that the electrical apparatus is substantially filled with said liquid solvent during said introducing, removing and recirculating steps, said steps effectively and substantially removing the polychlorinated biphenyls from the electrical apparatus so that the leaching of residual polychlorinated biphenyls into the dielectric fluid will not exceed 50 ppm.

16. A process for removing polychlorinated biphenyls and other contaminants from transformers and other electrical apparatus, and wherein the steps for so removing polychlorinated biphenyls from operating electrical apparatus are:

(a) de-energizing the electrical apparatus;

(b) introducing to the apparatus a liquid solvent having a boiling point lower than that of polychlorinated biphenyls and in which the polychlorinated biphenyls are soluble so as to be dissolved within said solvent, said solvent having sufficient dielectric properties to serve as the dielectric fluid;

(c) energizing the electrical apparatus thereby placing the electrical apparatus back in operation;

(d) removing said liquid solvent from the electrical apparatus and cleansing the polychlorinated biphenyls therefrom;

(e) recirculating said cleansed liquid solvent back to the electrical apparatus for reuse therein; and (f) maintaining the level of said liquid solvent in the electrical apparatus such that the electrical apparatus is substantially filled with said liquid solvent during said introducing, removing and recirculating steps, said steps effectively and substantially removing the polychlorinated biphenyls from the electrical apparatus so that the leaching of residual polychlorinated biphenyls into the dielectric fluid will not exceed 50 ppm.

17. A process for removing polychlorinated biphenyls in the dielectric fluid of an operating transformer comprising the steps of:

(a) de-energizing the transformer;

(b) draining the transformer of the dielectric fluid;

(c) filling the transformer with a dielectric fluid in liquid phase in which polychlorinated biphenyls are soluble;

(d) energizing the transformer;

(e) conducting said dielectric fluid in liquid phase to a cleansing means and separating the polychlorinated biphenyls dissolved in said dielectric fluid from said dielectric fluid;

(f) circulating said dielectric fluid from said cleansing means back to the transformer for repetition of the removal of dielectric fluid therefrom to the cleansing means, thus causing the polychlorinated biphenyls to concentrate in said cleansing means, said steps effectively and substantially removing the polychlorinated biphenyls from the transformer so that the leaching of residual polychlorinated biphenyls into the dielectric fluid will not exceed 50 ppm.

18. A process for removing polychlorinated biphenyls from an operating transformer as recited in claim 17 wherein:

said cleansing means is a distillation vessel.

19. A process for removing polychlorinated biphenyls from an operating transformer as recited in claim 17 further comprising:

maintaining the level of said dielectric fluid in liquid phase during said circulating and conducting steps such that the transformer remains substantially filled.

20. A process for removing polychlorinated biphenyls from an operating transformer as recited in claim 17 further comprising:

cooling the operating transformer to maintain the temperature and pressure of the transformer within the operating limits of the transformer.

21. A process for removing polychlorinated biphenyls from an operating transformer as recited in claim 20 wherein said dielectric fluid is one member of the following group:

(a) trichlorotrifluoroethane;

(b) perchloroethylene;

(c) a mixture of trichlorotrifluoroethane and perchloroethylene.

* * * * *